US007578220B2

(12) United States Patent
Chen

(10) Patent No.: US 7,578,220 B2
(45) Date of Patent: Aug. 25, 2009

(54) HAND TOOL WITH A CLUTCH DEVICE

(76) Inventor: Chang-Ying Chen, 12F-4, No. 666, Sec. 2, Wuquan W. Rd., Nantun District, Taichung (TW)

( * ) Notice: Subject to any disclaimer, the term of this patent is extended or adjusted under 35 U.S.C. 154(b) by 0 days.

(21) Appl. No.: 11/892,821

(22) Filed: Aug. 28, 2007

(65) Prior Publication Data

US 2009/0056512 A1 Mar. 5, 2009

(51) Int. Cl.
*B25B 23/157* (2006.01)

(52) U.S. Cl. ..... 81/473

(58) Field of Classification Search ..... 81/473, 81/474, 438, 177.2, 489
See application file for complete search history.

(56) References Cited

U.S. PATENT DOCUMENTS 5,836,223 A * 11/1998 Lin ..... 81/436
6,439,086 B1 * 8/2002 Bahr ..... 81/467
2008/0047404 A1 * 2/2008 Richter et al. ..... 81/438
2008/0087142 A1 * 4/2008 Lin ..... 81/177.1

* cited by examiner

*Primary Examiner*—David B Thomas

(57) ABSTRACT

A hand tool includes a handle a shank is inserted into an axial recess in the handle. Multiple first teeth extend inward from an inner periphery of the axial recess. Two plates extend axially from the top end of the handle and each plate includes a hook which has an inclined surface. A movable member is mounted to the top end of the handle and includes two extensions and each extension has a second inclined surface. A tubular member is mounted to the shank and multiple second teeth extend outward from the tubular member and are removably engaged with the first teeth. The two hooks removably hold the tubular member when a large torque is needed to be output, and the two hooks release the tubular member by pushing the movable member to move the two plates outward, the shank and the tubular member can be co-rotated with small torque.

5 Claims, 7 Drawing Sheets

HAND TOOL WITH A CLUTCH DEVICE

FIELD OF THE INVENTION

The present invention relates to a hand tool with a clutch device which releases the shank to quickly rotate the object with small torque and connects the shank when a large torque is needed.

BACKGROUND OF THE INVENTION

A conventional screw driver generally includes a handle and a shank has one end fixed to the handle and the other end of the shank has a function end which is engaged with an object such as a nut or a screw. The user holds and rotates the handle and the shank is rotated to loosen or tighten the object. The handle has a diameter that is larger than a diameter of the shank so that when rotating the handle, the shank is rotated to apply a large torque to loosen or tighten the object. It is noted that during loosening the object, only the beginning step requires a larger torque, once the object is loosened, the object can be easily rotated with smaller torque. However, the user cannot quickly rotate the screw driver by rotating the handle. In other words, the conventional screw tool does not have a function that is needed to quickly rotate the object.

The present invention intends to provide a hand tool that includes a clutch device in the handle and the shank is engaged with the clutch device when a large torque is needed to be applied to the object, and when the clutch device releases the shank, the shank can be quickly rotated independently with small torque.

SUMMARY OF THE INVENTION

The present invention relates to a hand tool which comprises a handle having an axial recess which communicates with an opening in a top end of the handle. A plurality of first teeth extend inward from an inner periphery of a periphery of the opening. Two plates extend axially from the top end of the handle and each plate has a hook which has an inclined surface. A movable member is mounted to the top end of the handle and two extensions extend from an inner periphery of the movable member. Each extension has a second inclined surface which is located corresponding to the first inclined surface so that when the second inclined surfaces push the first inclined surfaces, the two plates being pushed outward. A shank has a first end inserted into the axial recess and the first end of the shank is biased by a spring in the axial recess. A tubular member has a passage through which the shank extends. A plurality of second teeth extend outward from the tubular member and removably engaged with the first teeth. The two hooks removably hold the tubular member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
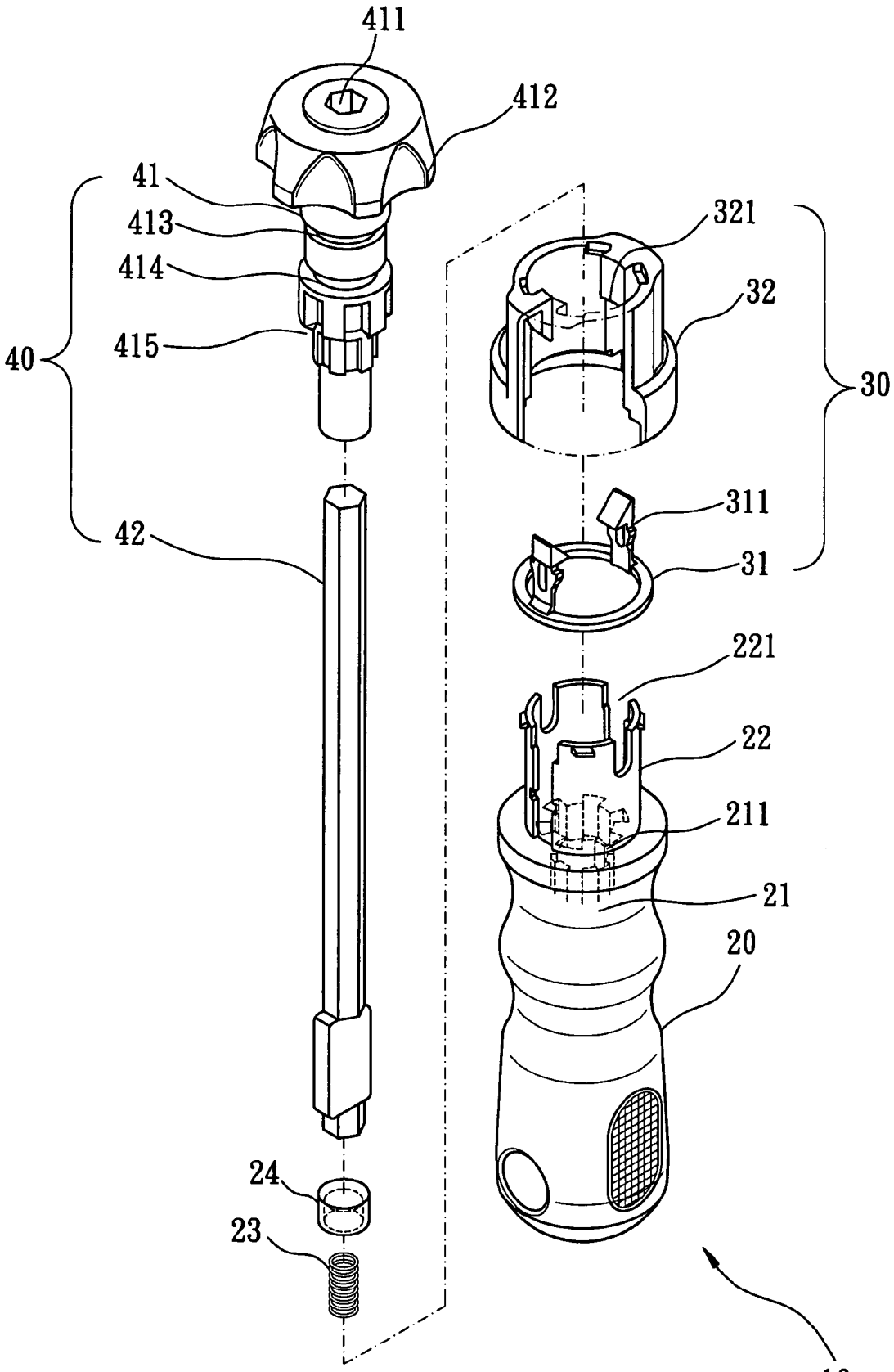
FIG. 1 is an exploded view to show the hand tool of the present invention.
Figure 2:
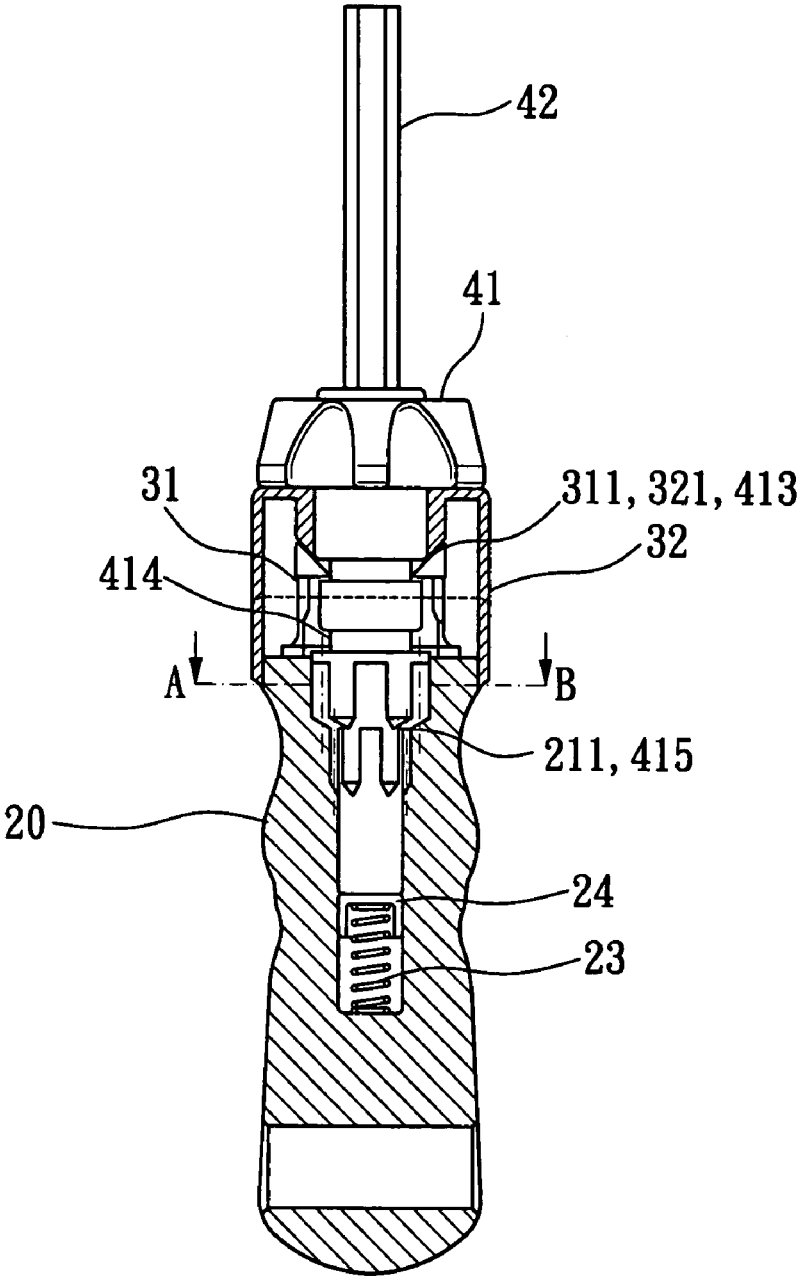
FIG. 2 is a cross sectional view of the hand tool of the present invention.
Figure 3:
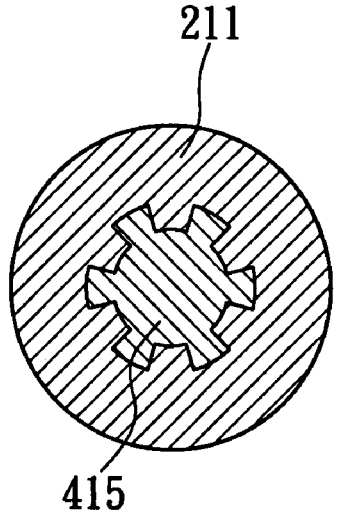
FIG. 3 is a cross sectional view, taken along line A-B in FIG. 2.
Figure 4:
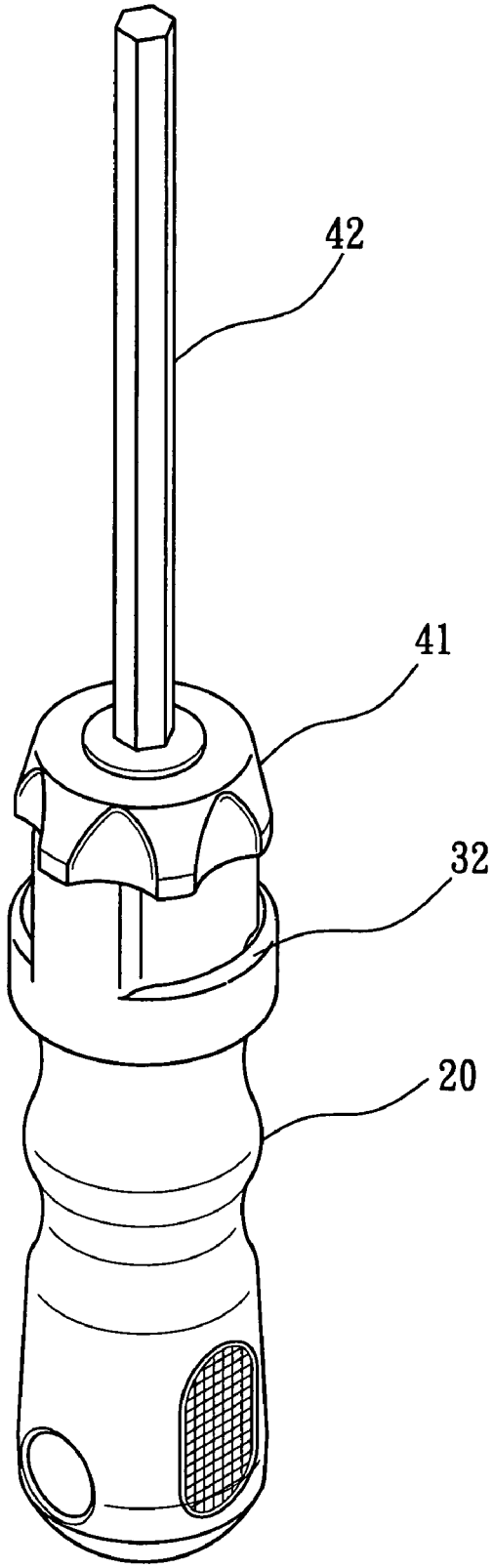
FIG. 4 is a perspective view to show the hand tool of the present invention.
Figure 5:
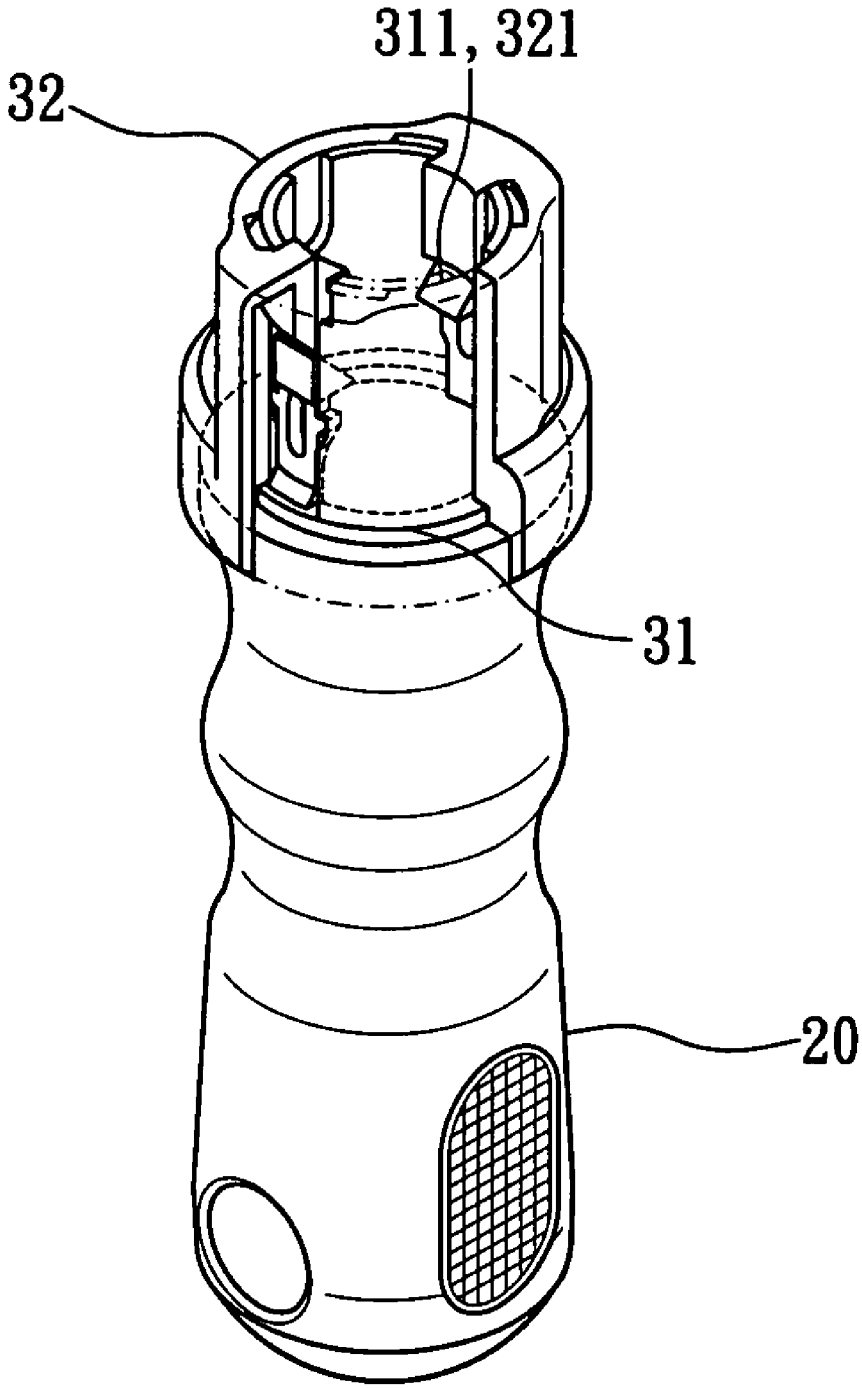
FIG. 5 is a perspective view to show the handle of the hand tool of the present invention.

Referring to FIGS. 1 to 5, the hand tool of the present invention comprises a handle 20 having an axial recess 21 defined therein which communicates with an opening in a top end of the handle 20. A plurality of first teeth 211 extend inward from an inner periphery of a periphery of the opening. Two curved plates 22 extend from the top end of the handle 20 so as to define two slots 221 therebetween. A clutch device is connected to the handle 20 and includes a ring 31 which mounted to the two curved plates 22 and two plates extend from the ring 31, each plate has a hook 311 which has a first inclined surface. The tow plates are located in the two slots 221, the movably member 32 is movably mounted to the two curved plates 22.

A movable member 32 is mounted to the two curved plates 22 on the top end of the handle 20 and two extensions 321 extend from an inner periphery of the movable member 32. Each extension 321 has a second inclined surface which is located corresponding to the first inclined surface so that when the second inclined surfaces push the first inclined surfaces, the two plates being pushed outward.

A driving unit includes a tubular member 41 and a shank 42, wherein the shank 42 has a first end inserted into the axial recess 21 and is connected to a cap 24. The cap 24 has a concavity defined in an underside thereof so that one end of a spring 23 is received in the concavity and the other end of the spring 23 is rested on an inner end of the axial recess 21. The shank 42 is biased by the spring 23.

The tubular member 41 has a passage 411 through which the shank 42 extends. The passage 411 is a polygonal passage and the shank 42 has a polygonal cross section so that the shank 42 and the tubular member 41 are co-rotated. A plurality of second teeth 415 extend outward from the tubular member 41 and are removably engaged with the first teeth 211. The tubular member 41 includes a first groove 413 and a second groove 414 defined in the outer periphery thereof. The two hooks 311 are engaged with one of the first and second grooves 413, 414. The tubular member 41 includes a head which has a plurality of protrusions 412 extending radially therefrom so that the user can easily operate the tubular member 41 by rotating the protrusions 412.

Figure 6:
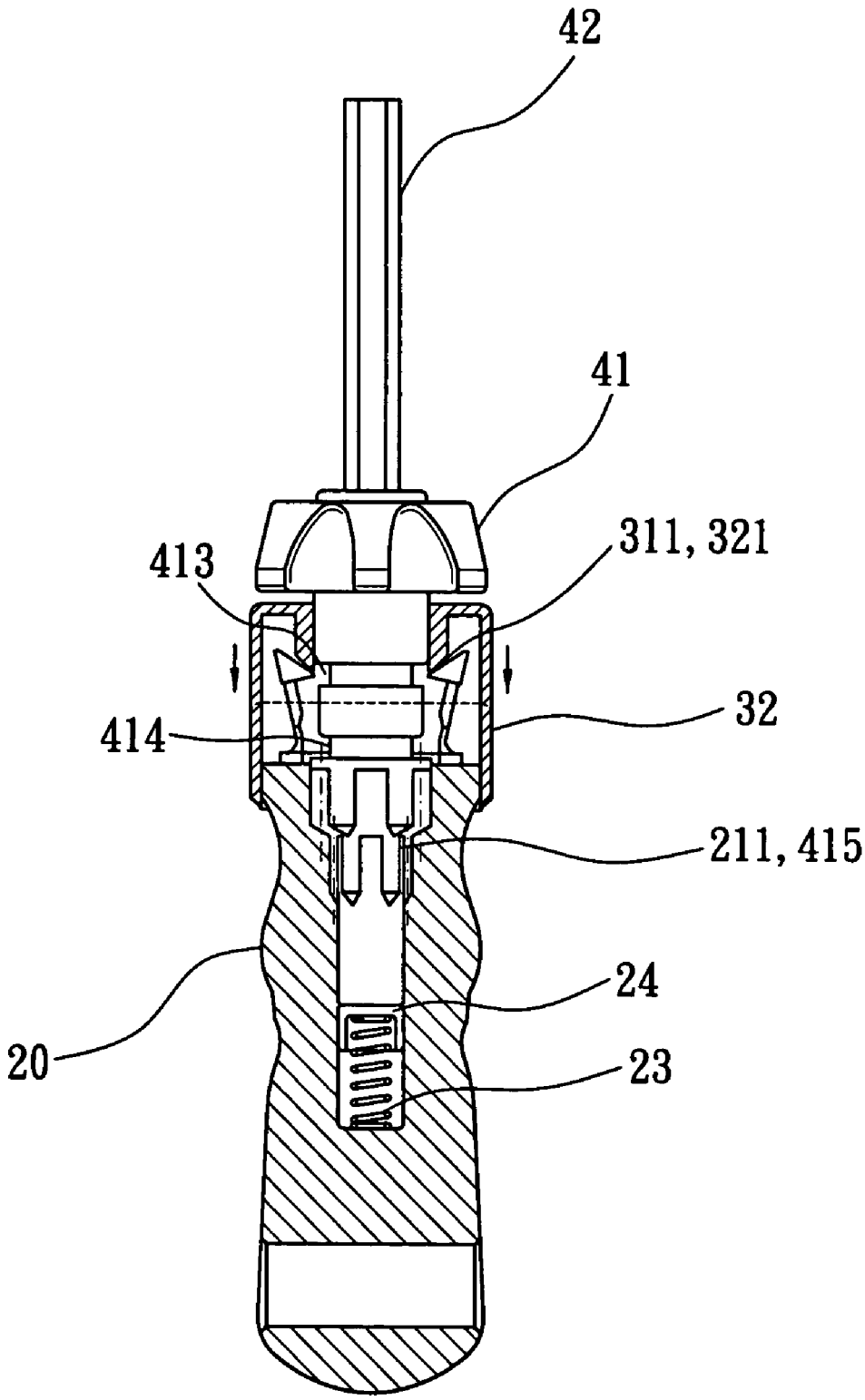
FIG. 6 is a partial cross sectional view to show that the movable member is pushed downward to outwardly push the plates.
Figure 7:
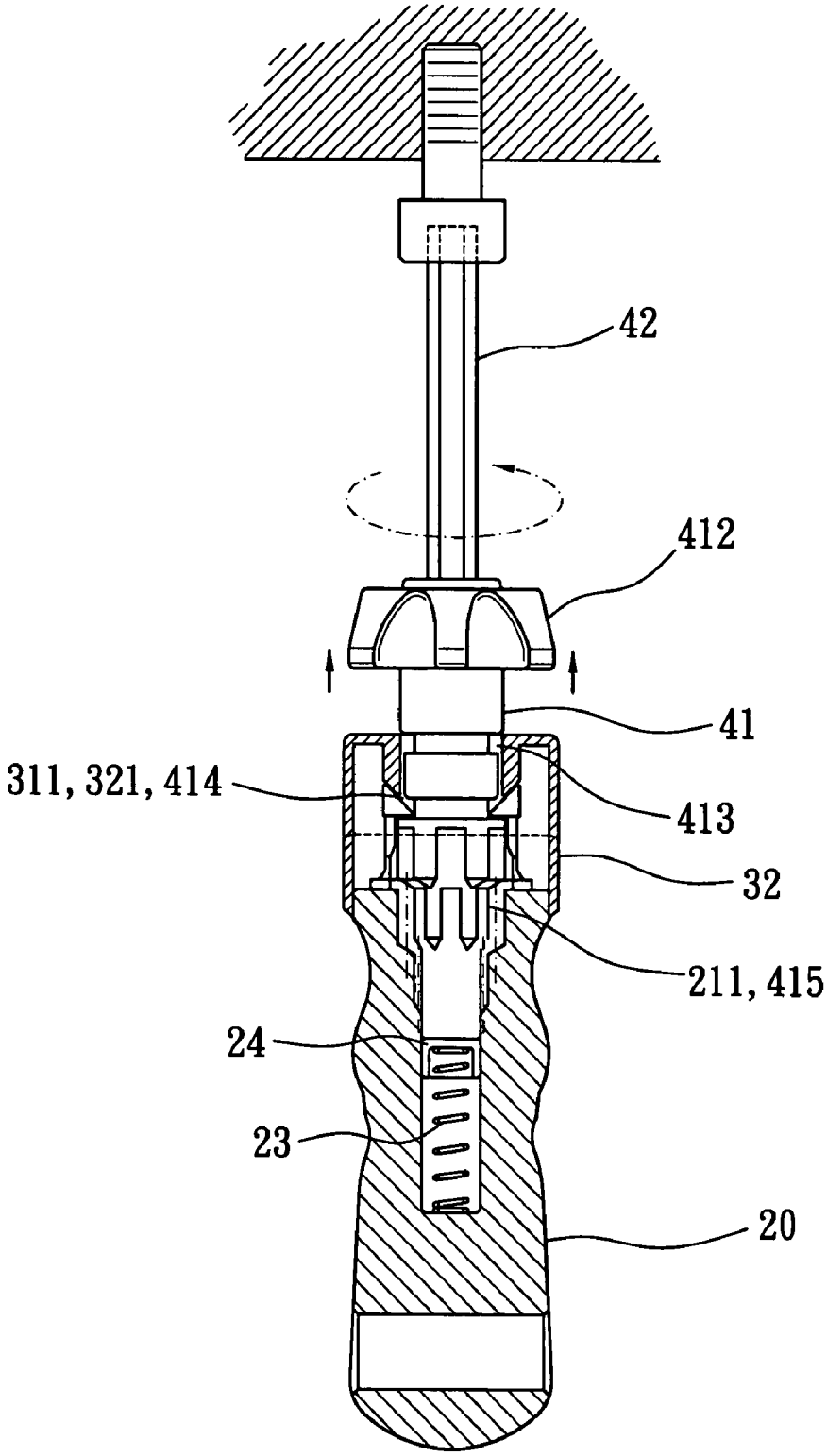
FIG. 7 is a partial cross sectional view to show that the shank and the tubular member are moved upward and can be rotated quickly with small torque.
Figure 8:
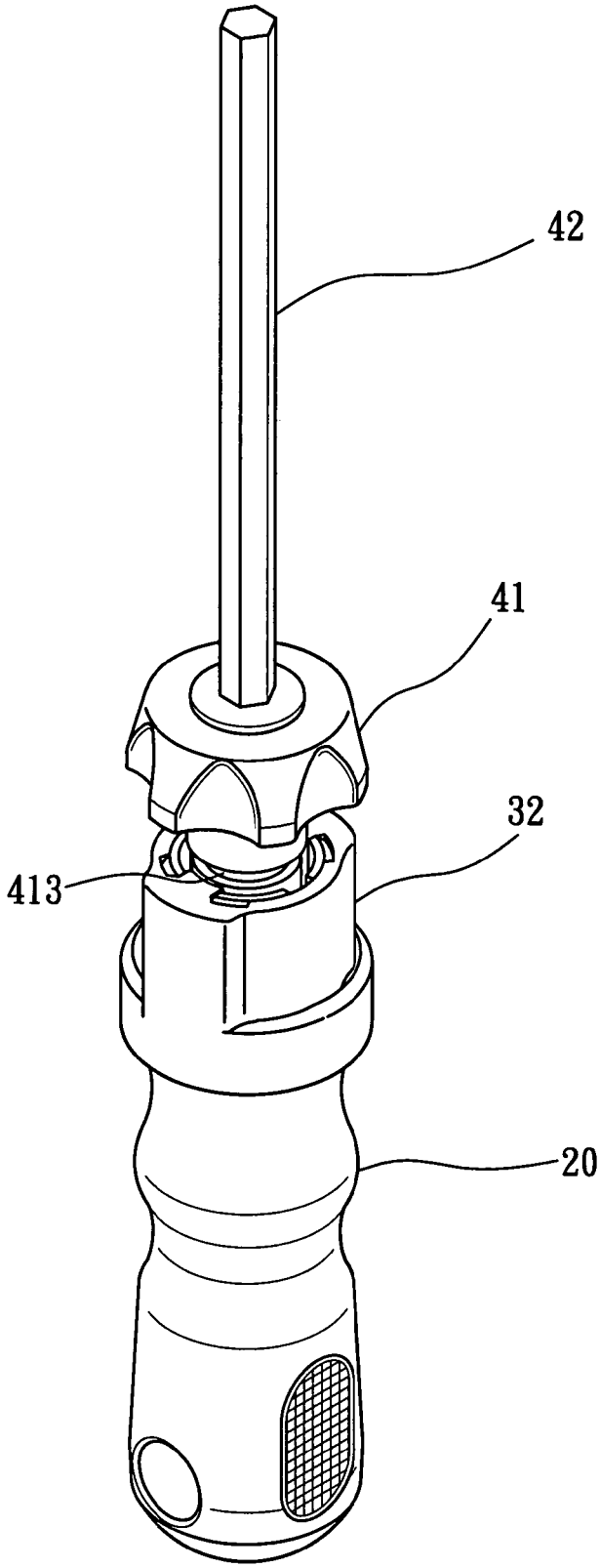
FIG. 8 is a perspective view to show that the shank and the tubular member are moved upward.

Referring to FIGS. 6 to 8, when a small torque is needed to quickly rotate the object, the movable member 32 is pushed downward so that the two second inclined surfaces of the two extensions 321 are moved to push the two first inclined surfaces of the two plates 311 of the ring 31, so that the two hooks are removed from the first groove 413 and the tubular member 41 and the shank 42 can be pulled upward. The first teeth 211 are disengaged from the second teeth 415 and the shank 42 together with the tubular member 41 are rotatable independently. In other words, the user holds the handle 20 by one hand and rotates the tubular member 41 by the other hand to quickly rotate the object.

The hand tool 10 can apply a large torque to the object when the first and second teeth 211, 415 are engaged with each other, the shank 42 and the tubular member 41 are positioned by the engagement of the two hooks 311 and the first groove 413. When a small torque is needed to quickly rotate the object, the movable member 32 is pushed downward to outward push the two hooks 311, the shank 42 and the tubular member 41 can be pulled upward. The shank 42 can be rotated without rotating the handle 20.

While we have shown and described the embodiment in accordance with the present invention, it should be clear to those skilled in the art that further embodiments may be made without departing from the scope of the present invention.

What is claimed is:

1. A hand tool comprising:

a handle having an axial recess defined therein which communicates with an opening in a top end of the handle, a plurality of first teeth extending inward from an inner periphery of a periphery of the opening;

two plates extending axially from the top end of the handle and each plate having a hook which has a first inclined surface;

a movable member mounted to the top end of the handle and two extensions extending from an inner periphery of the movable member, each extension having a second inclined surface which is located corresponding to the first inclined surface so that when the second inclined surfaces push the first inclined surfaces, the two plates being pushed outward;

a shank having a first end inserted into the axial recess and biased by a spring in the axial recess, and a tubular member having a passage through which the shank extends, a plurality of second teeth extending outward from the tubular member and removably engaged with the first teeth, the two hooks removably holding the tubular member.

2. The hand tool as claimed in claim 1, wherein two curved plates extend from the top end of the handle so as to define two slots therebetween, a ring is mounted to the two curved plates and the two plates are located in the two slots, the movably member is movably mounted to the two curved plates.

3. The hand tool as claimed in claim 1, wherein the passage is a polygonal passage and the shank has a polygonal cross section so that the shank and the tubular member are co-rotated.

4. The hand tool as claimed in claim 1, wherein the tubular member includes a first groove and a second groove defined in the outer periphery thereof, the two hooks are engaged with one of the first and second grooves.

5. The hand tool as claimed in claim 1, wherein the tubular member includes a head which has a plurality of protrusions extending radially therefrom.

* * * * *